US008550169B2

(12) United States Patent
McKay et al.

(10) Patent No.: US 8,550,169 B2
(45) Date of Patent: Oct. 8, 2013

(54) CONNECTOR

(75) Inventors: David Ernest McKay, Kincardineshire (GB); Drummond Lawson, Aberdeenshire (GB); Malcolm George Cameron Milne, Aberdeenshire (GB)

(73) Assignee: Subsea Technologies Group Limited, Aberdeen (GB)

( * ) Notice: Subject to any disclaimer, the term of this patent is extended or adjusted under 35 U.S.C. 154(b) by 68 days.

(21) Appl. No.: 12/531,057

(22) PCT Filed: Mar. 13, 2008

(86) PCT No.: PCT/GB2008/000888
§ 371 (c)(1),
(2), (4) Date: Feb. 26, 2010

(87) PCT Pub. No.: WO2008/113979
PCT Pub. Date: Sep. 25, 2008

(65) Prior Publication Data

US 2010/0139925 A1 Jun. 10, 2010

(30) Foreign Application Priority Data

Mar. 16, 2007 (GB) ..... 0705093.3

(51) Int. Cl.
*E21B 23/00* (2006.01)
*E21B 17/02* (2006.01)

(52) U.S. Cl.
USPC ..... 166/343; 166/344; 166/360; 166/379; 166/85.5; 285/920; 403/322.3

(58) Field of Classification Search
USPC ..... 166/343, 338, 339, 341, 344, 349, 351, 166/352, 360, 365, 367, 368, 378–381, 166/77.1, 77.51, 85.1, 85.5; 285/920, 322; 403/321, 322.1, 322.3
See application file for complete search history.

(56) References Cited

U.S. PATENT DOCUMENTS 3,032,125 A * 5/1962 Hiser et al. ..... 175/7
3,498,324 A * 3/1970 Breuning ..... 137/614.04
3,551,005 A * 12/1970 Brun ..... 285/10
3,701,549 A * 10/1972 Koomey et al. ..... 285/24
3,841,665 A * 10/1974 Capot ..... 285/2
3,846,992 A * 11/1974 Liautaud ..... 405/169

(Continued)

FOREIGN PATENT DOCUMENTS

EP 0 902 505 A2 3/1999
EP 1 676 975 A2 7/2006

(Continued)

OTHER PUBLICATIONS

Search Report under Section 17 for Application No. GB0705093.3 (Dec. 12, 2007).

(Continued)

*Primary Examiner* — Matthew Buck
(74) *Attorney, Agent, or Firm* — Jenkins, Wilson, Taylor & Hunt, P.A.

(57) ABSTRACT

A connector (1) for connecting components of a subsea system, the connector comprising male and female components (3, 2), guide means (11) for assisting preliminary orientation of the male component within the female component and means (18; 20; 21) for drawing the male component into the female component and latch means (22) for securing the male component within the female component.

20 Claims, 7 Drawing Sheets

(56) References Cited

U.S. PATENT DOCUMENTS

| | | | | | |
|---|---|---|---|---|---|
| 4,174,875 | A | * | 11/1979 | Wilson et al. | 439/349 |
| 4,191,256 | A | * | 3/1980 | Croy et al. | 166/343 |
| 4,347,012 | A | * | 8/1982 | Glidden | 403/2 |
| 4,460,156 | A | * | 7/1984 | Hazelrigg et al. | 251/149.3 |
| 4,489,959 | A | * | 12/1984 | Satterwhite | 285/18 |
| 4,490,073 | A | * | 12/1984 | Lawson | 405/169 |
| 4,585,369 | A | * | 4/1986 | Manesse et al. | 403/322.3 |
| 4,679,824 | A | * | 7/1987 | Rodriguez et al. | 285/27 |
| 4,708,524 | A | * | 11/1987 | Goris | 405/169 |
| 4,823,878 | A | * | 4/1989 | Brammer et al. | 166/341 |
| 4,823,879 | A | * | 4/1989 | Brammer et al. | 166/341 |
| 4,893,677 | A | * | 1/1990 | Brammer et al. | 166/341 |
| 5,004,272 | A | * | 4/1991 | Kipp | 285/24 |
| 5,143,483 | A | * | 9/1992 | Petersen | 405/191 |
| 5,947,642 | A | * | 9/1999 | Teixeira et al. | 405/195.1 |
| 6,068,427 | A | * | 5/2000 | Østergaard | 405/191 |
| 6,089,321 | A | * | 7/2000 | Morrill | 166/341 |
| 6,106,026 | A | * | 8/2000 | Smith, III | 285/85 |
| 6,409,428 | B1 | * | 6/2002 | Moog | 405/169 |
| 6,736,082 | B2 | * | 5/2004 | Breivik et al. | 114/230.1 |
| 6,805,382 | B2 | * | 10/2004 | Jennings | 285/18 |
| 6,890,005 | B1 | * | 5/2005 | Chisnell | 285/208 |
| 7,195,283 | B2 | * | 3/2007 | Chisnell | 285/208 |
| 7,225,877 | B2 | * | 6/2007 | Yater | 166/344 |
| 7,402,000 | B2 | * | 7/2008 | Bastesen et al. | 405/170 |
| 7,967,070 | B2 | * | 6/2011 | Reddy | 166/341 |

FOREIGN PATENT DOCUMENTS

| | | | |
|---|---|---|---|
| GB | 2 178 101 | A | 2/1987 |
| GB | 2 261 271 | A | 5/1993 |
| WO | WO 89/03002 | A | 4/1989 |
| WO | WO 92/12554 | A | 7/1992 |

OTHER PUBLICATIONS

International Search Report for International Application No. PCT/GB2008/000888 (Aug. 20, 2008).

* cited by examiner

CONNECTOR

This invention relates to a connector for connecting well servicing and like equipment together or connecting such well servicing equipment to well heads or the like. The invention particularly relates to a subsea connector for use in intervention systems on subsea wellheads and more particularly to a connector for joining individual components of such systems remotely by means of applied hydraulic pressure.

Off-shore production may be carried out from a subsea well head which is completed on the sea floor. A riser may be installed to provide a means for conveying tools from the surface to the subsea well head or tree and subsequently into the well below. The riser may be formed of one of more tubular sections connected together. Individual sections of the riser may provide different functions in relation to transportation of tools from surface to subsea and vice versa. In the following discussion, lubricator sections will be described but other riser components are similarly covered by the scope of the present invention.

Where a number of individual riser sections are required to reach the surface, adjacent sections are joined together through connectors.

During drilling, testing and operation of an oil well it is often necessary to insert and withdraw instruments such as well logging instruments and to deploy tools to replace equipment such as valves, pressure plugs etc. These operations are often carried out by a technique known as wirelining where the component to be inserted into the well is lowered into the well suspended from a wire.

The instrument may be lowered into the well head through a connector joining two adjacent riser sections together. One half of the connector is provided on the upper end of the existing installation and the mating half of the connector and the instrument to be inserted in the wellhead may be supported independently from the surface. Alternatively the mating half of the connector may be supported on the instrument itself.

With valves below the lower female connector component closed against the well fluid pressure, the male component is lowered until the instrument is inserted into the female component of the connector and the male component therefore plugs the top of the riser. Once a fluid tight pressure seal is established, the lower valve can be opened and the instrument lowered into the well head.

Known remotely actuated connectors are formed from male and female components and the connector may establish both a physical connection between the two pieces of equipment and also a hydraulic or electrical connection between the components to provide control and actuation of the newly installed equipment. The remotely actuated connectors eliminate manual connection operations and repeated requirements for expensive divers and allows operations at depths divers cannot reach when connecting well servicing equipment to and disconnecting it from underwater wellheads.

The connector must achieve a number of functions during operation:— a) provide sufficient guidance of the male part of the connector into the female part;
b) allow remote unassisted engagement without damage to connector components and associated control lines;
c) provide a primary seal against internal well bore pressure;
d) lock on with sufficient structural strength to resist all internal pressure loading plus external loading, and
e) establish hydraulic, electrical and or optical communication across the interface of the male and female parts of the connector.

In the harsh environment in which the wirelining operations described above are carried out, and at the extreme depths that are encountered, any damage to the connector, particularly during insertion of the male component of the connector into the female component of the connector can lead to damage of the main seal across the connector, or damage to the hydraulic, electrical or optical couplings within the connector.

Where this occurs, the wirelining operation has to be carried out again to remove the installed equipment and raise the damaged connector to the surface. The connector then has to be inspected and replaced or repaired. If the damage has occurred to the lower part of the connector, then both pieces of equipment may have to be removed from the well before further operations can be restarted.

The present invention aims to provide a connector which satisfies or at least mitigates each of the above functions.

According to one aspect of the present invention there is provided a connector for connecting components of a subsea system, the connector comprising male and female components, guide means for assisting preliminary orientation of the male component within the female component and means for drawing the male component into the female component and latch means for securing the male component within the female component.

Preferably, the guide means comprises a tapered surface provided on the female component.

Advantageously, the tapered surface is a cone provided on one end of the female component.

Preferably the surface of the cone is smooth to prevent any damage to the male component during initial contact with the surface.

Preferably also, the guiding means comprises a cone on the male component to assist in the initial guidance of the male component into the female component.

Preferably, the means for drawing the male component into the female component comprises an abutment surface mounted within the female component.

Preferably the male component comprises an abutment surface which co-operates with the abutment surface of the female component when the male component is inserted into the female component.

Advantageously, the abutment surfaces are annular.

Preferably, the abutment surface of the female component is vertically moveable within the female component.

Preferably also, means are provided for raising and lowering the female abutment surface within the female component.

Advantageously, said means are hydraulic means.

Preferably also, means are provided for applying a force radially against the male component abutment surface to mechanically grip the male component within the female component before drawing the male component into the female component.

Preferably the radial force applicator is a hydraulic piston.

Conveniently, the male and female components are provided with cooperating surfaces for establishing connection of hydraulic, electric or optical devices across the connector.

Preferably, the cooperating surfaces are annular.

Preferably, hydraulic, electric or optical coupling devices are provided on the female component, said devices being actuable to extend through the cooperating surface of the female component into the cooperating surface of the male component to establish a connection across the connector.

Alternatively, hydraulic, electric or optical coupling devices are provided on the male component, said devices being actuable to extend through the cooperating surface of the male component into the cooperating surface of the female component to establish a connection across the connector.

Advantageously, a frame is provided around the female component to allow for visual inspection of the component and ROV manipulation of the component. The frame also provides physical protection to the component and prevents snagging of guide wires, other cables or objects mitigating against potential dangers to vessel safety or well integrity on the female component.

Preferably the means for latching the male and female components together comprises one or more locking members on the female component which are extendable into one or more detents in the male component.

According to a further aspect of the present invention there is provided a method of connecting components of a subsea system together comprising the steps of mounting a male connector on one component and a female connector on the other, guiding the male connector into the female connector in a preliminary orientation and subsequently drawing the male component into the female component before locking the male component into position within the female component thereby creating full bore access axially through the connector.

According to a further aspect of the present invention there is provided a subsea system incorporating a connector according to the first aspect of the present invention.

Embodiments of the present invention will now be described with reference to and as shown in the accompanying drawings in which:—

Figure 1:
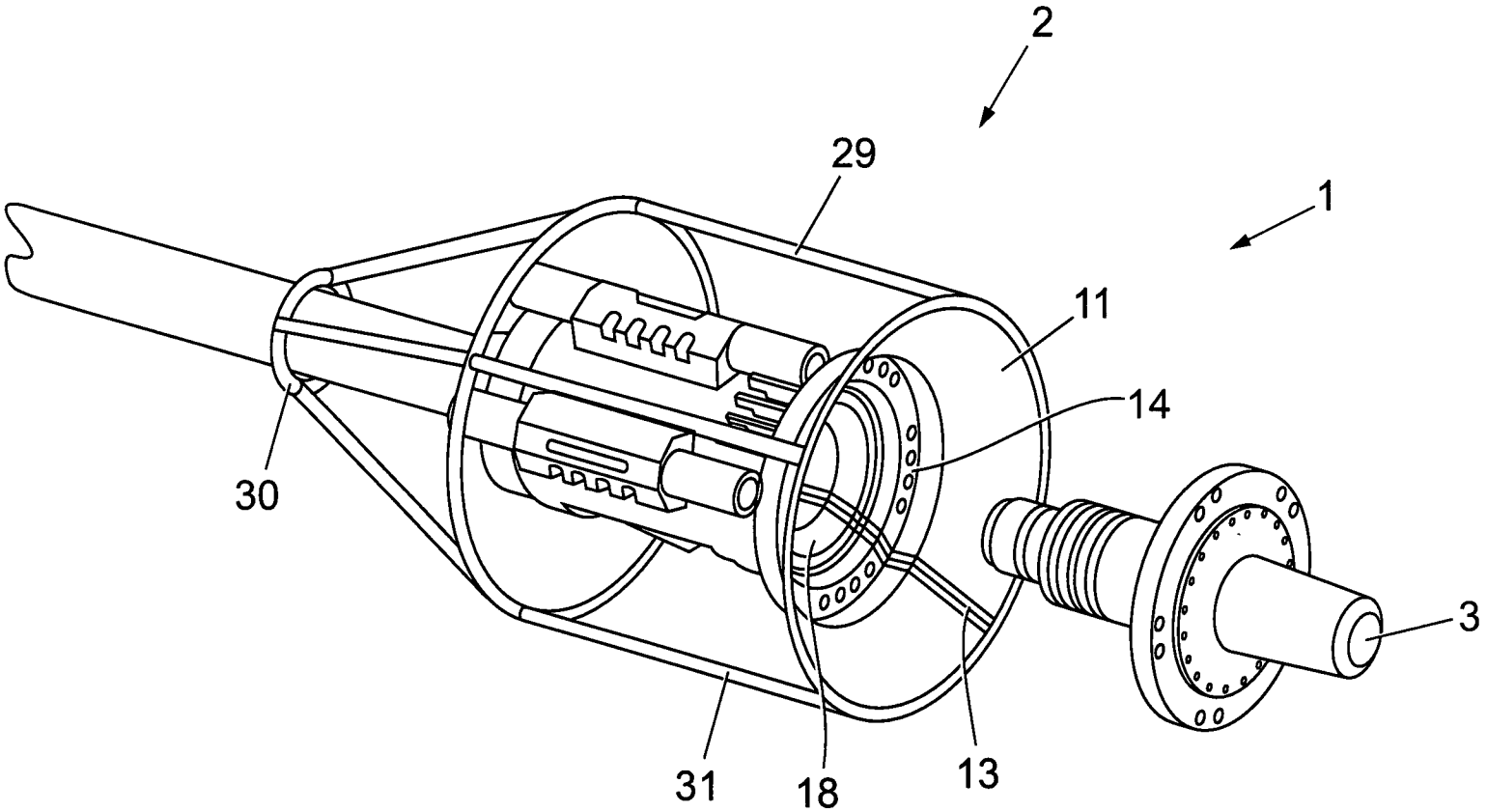
FIG. 1 is a perspective schematic view of a connector according to one aspect of the present invention.
Figure 2:
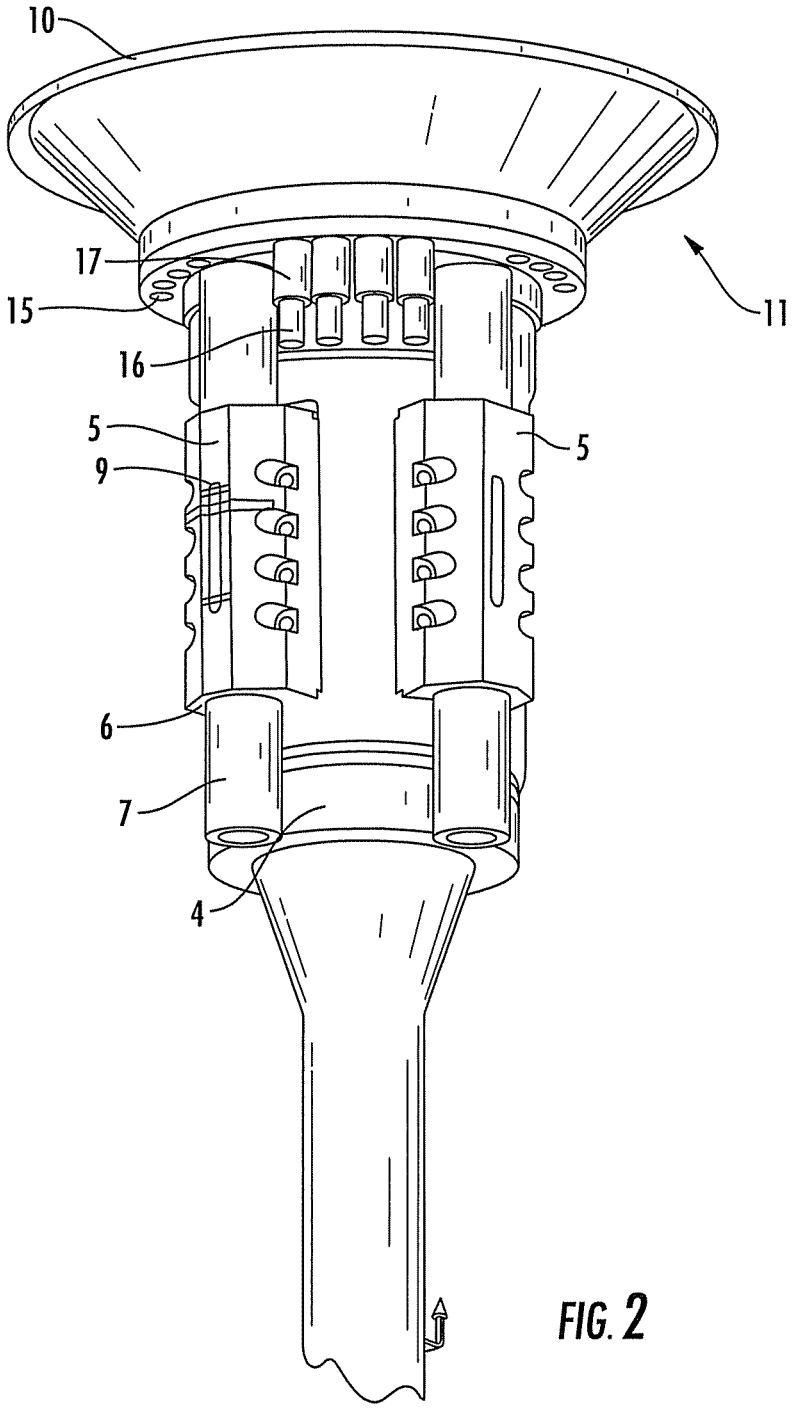
FIG. 2 is an enlarge perspective view from below of the female component of the connector of FIG. 1 mounted on a lubricator section and with the frame removed for clarity.
Figure 3:
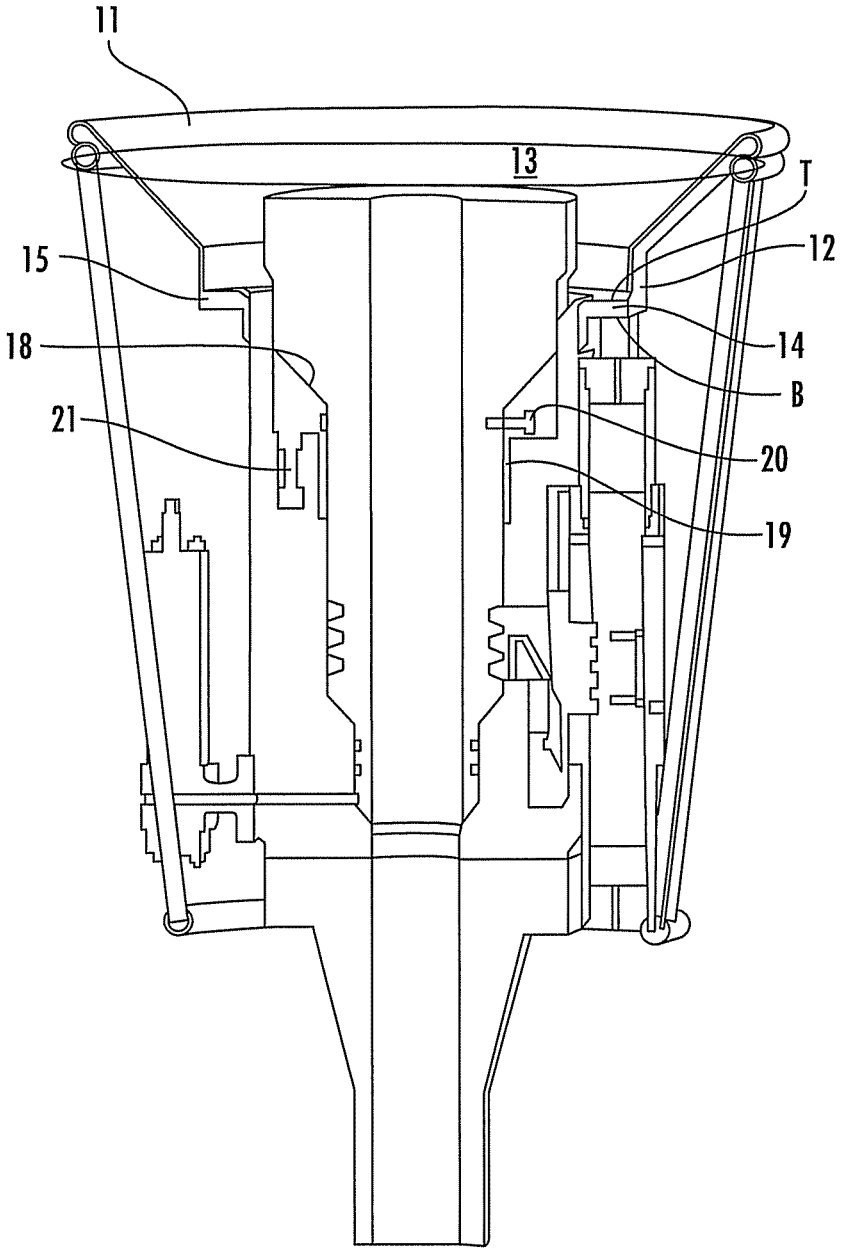
FIG. 3 is a schematic cross-sectional view through the female component.
Figure 3A:
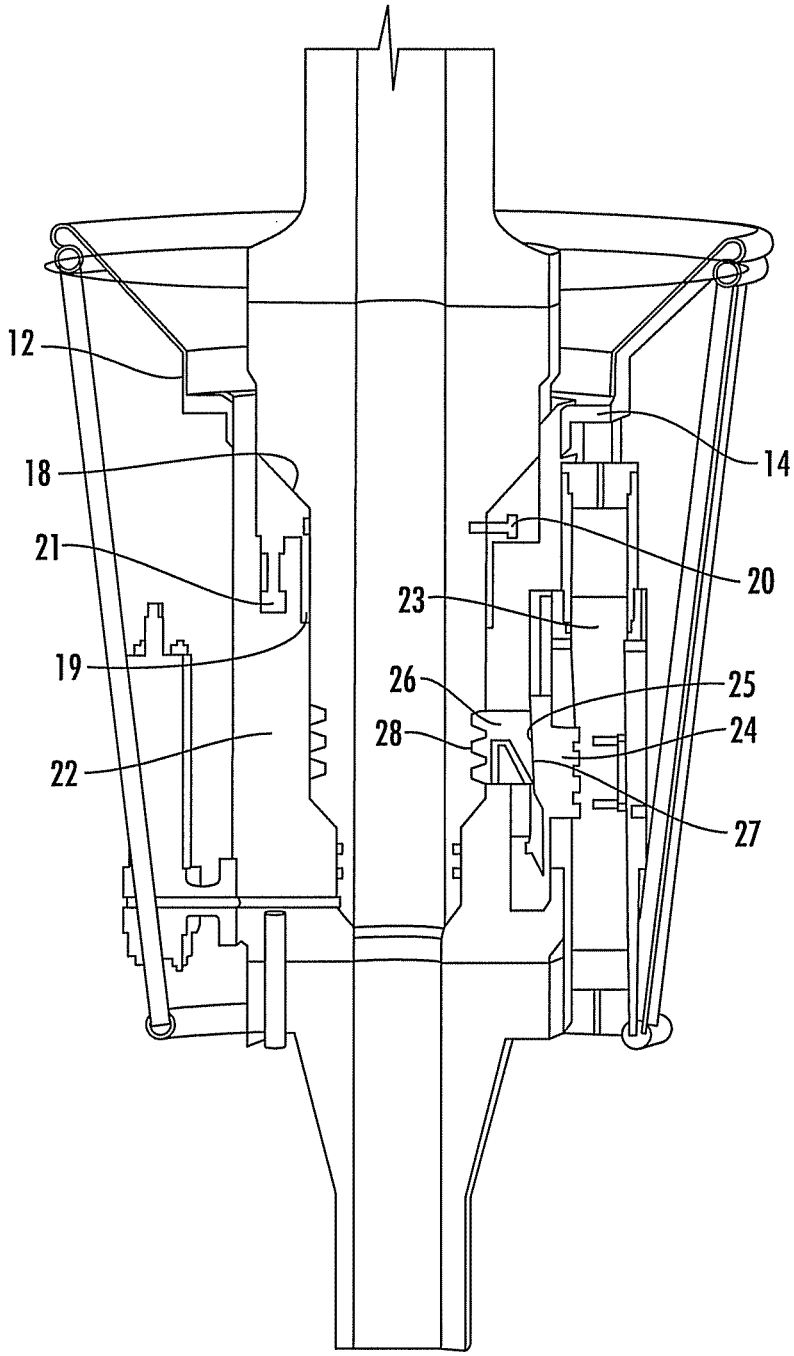
Figure 4:
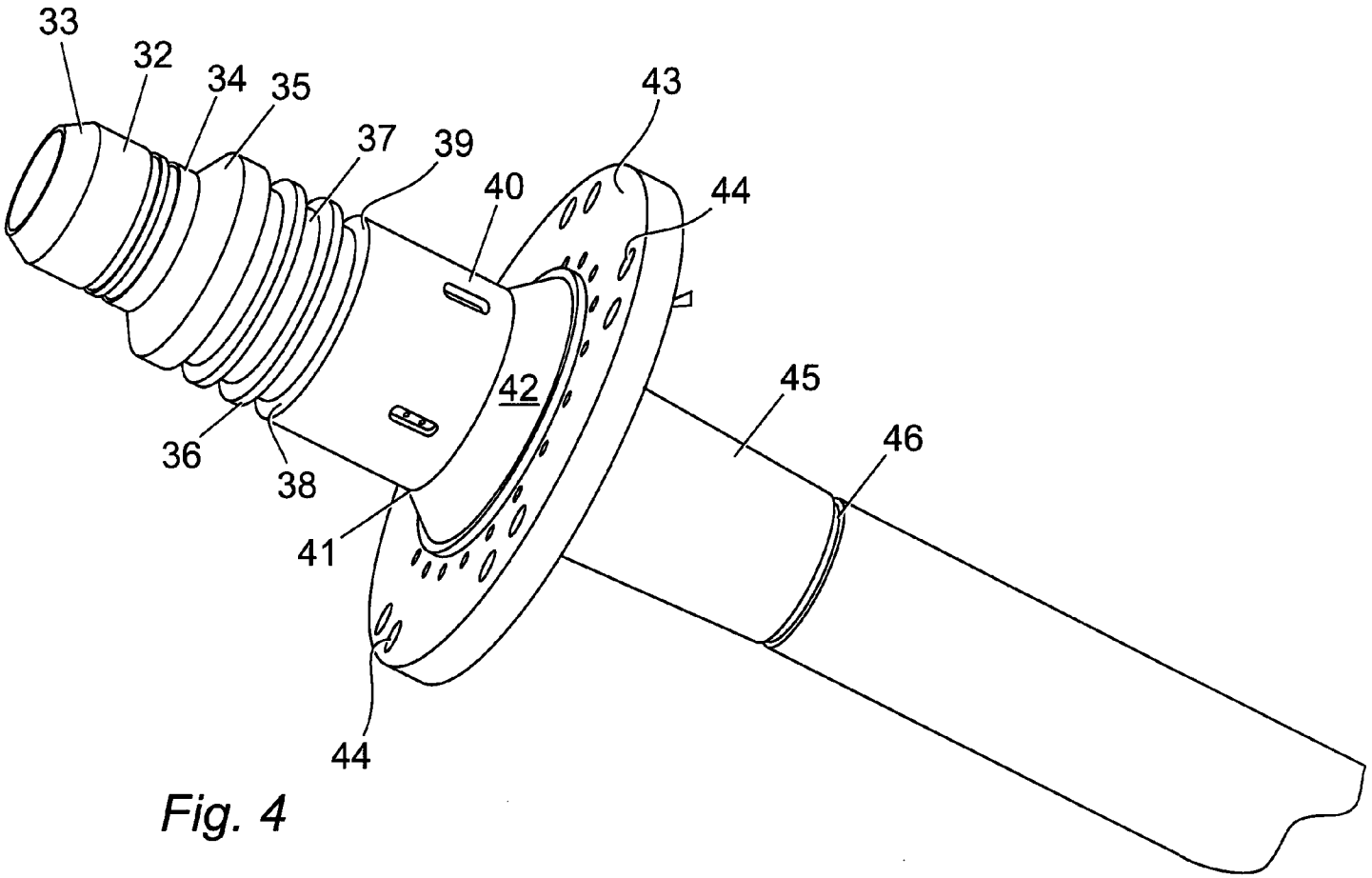
Figure 5:
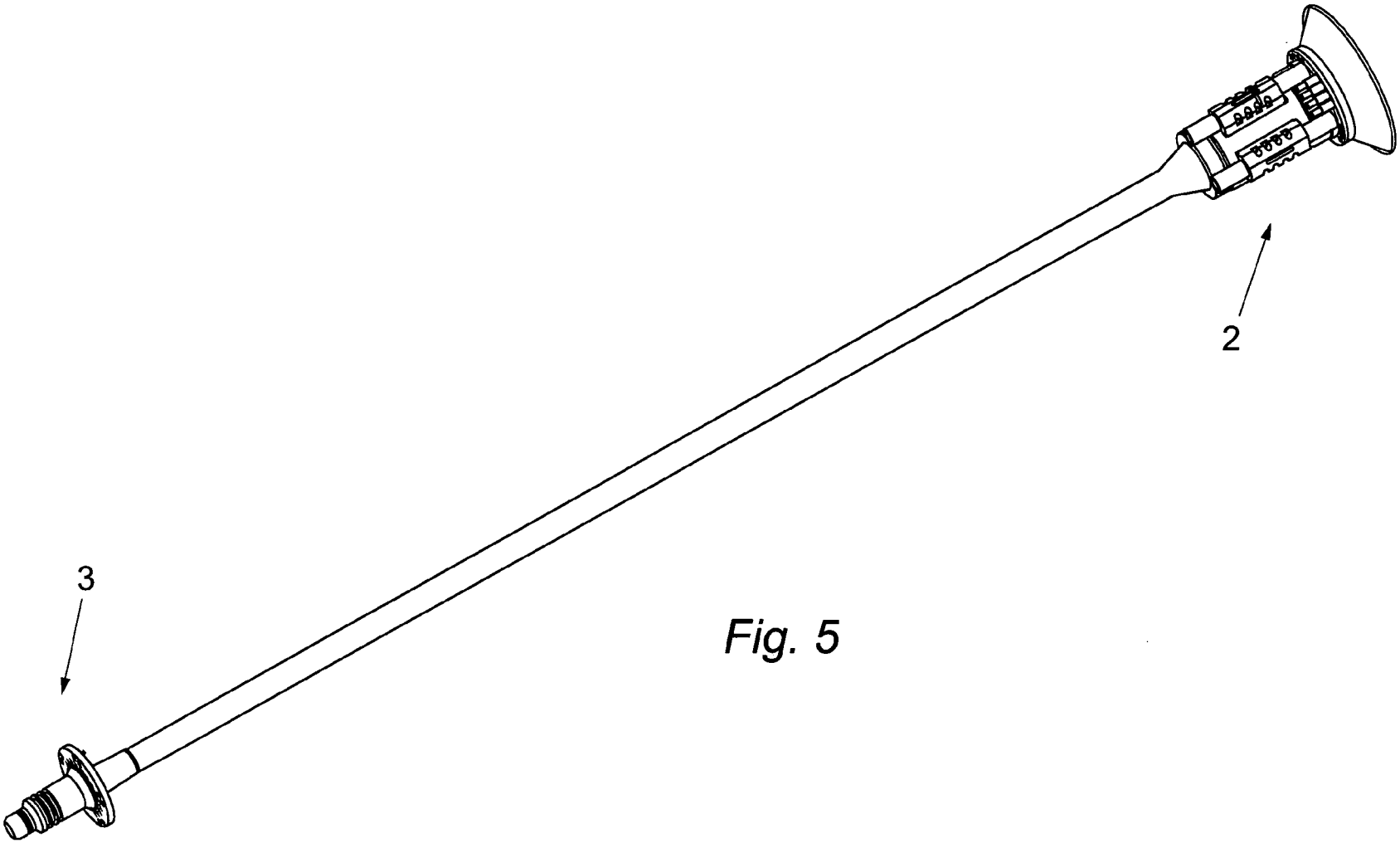
Figure 6:
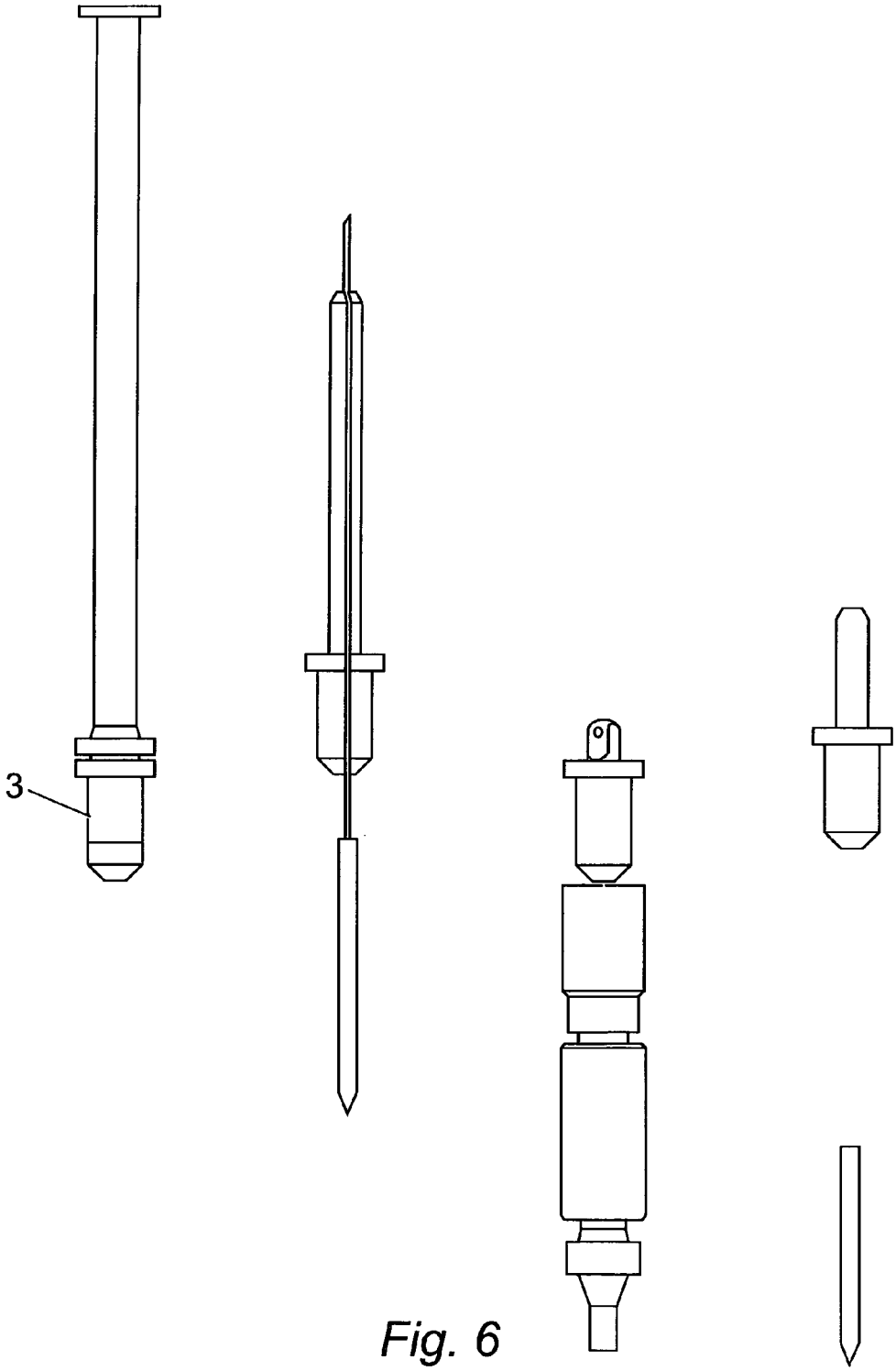

FIG. 3*a* is a further schematic cross-sectional view through the female component;

FIG. 4 is an enlarged perspective view from below of the male component of the connector of FIG. 1;

FIG. 5 is a perspective view of a lubricator section with male and female connector components mounted at either end, and FIG. 6 is an elevation view showing several different versions of male component for the connector of FIG. 1.

Turning now to the figures there is shown a connector 1 for connecting together subsea components such as for example, a lubricator to a well head or two lubricator sections. In the embodiments described below, the connectors are mounted on the ends of two adjacent lubricator sections which are to be connected together.

The connector comprises a female component 2 and a male component 3 each of which are adapted to be mounted in a known manner on an end of a lubricator section.

The female component comprises a hollow cylindrical housing 4 around which is provided a plurality of substantially rectangular hollow mounting means 5 which in this embodiment are secured to the outer surface of the housing but could be formed integrally therewith. The mounting means are each provided with an axial bore 6 therethrough.

Each mounting means serves as a guide for a hydraulic cylinder 7 which is axially mounted on the outer surface of the housing and passes through the bore of the mounting means. A piston (not shown) is provided within each cylinder.

An axial slot 9 is provided in the outer surface of the mounting means which serves to provide visual confirmation of the position of the piston within the cylinder. The slot also provides for the inclusion of direct override of the pistons in the event of hydraulic failure. This can be configured separately or in combination with the visual position indicator function. The override means may be direct mechanical. i.e. ROV or line from surfaces pulls up, or by independent hydraulics i.e. ROV places hydraulic cylinder to jack piston up.

The distal end 10 of the housing, remote from the lubricator section, is provided with a funnel comprising a cone 11 for guidance of a male component of the connector into the female component as will be described more fully below and a duct 12. The duct of the cone is mounted at the end of the hollow housing and provides for fluid communication between the lubricator section below the housing to the lubricator section to be mounted thereon.

The slope of the internal face 13 of the cone may be selected depending upon the size of the connector. The internal face of the cone is smooth in order to prevent any damage to the male component of the connector during insertion.

An annular flange 14 is provided in the duct of the funnel such that the region of the duct above the flange has a greater diameter than the region below the flange. The diameter of the duct below the flange is slightly greater than that of the housing of the female component to enable the funnel to be mounted thereon.

Additional annular flanges (not shown) may be provided to allow for additional through communication. Such additional flanges may be stepped or tiered or graduated or provided in any other suitable arrangement within the duct.

Annular flange 14 is provided with a plurality of bores 15 which extend through the flange from the top face T to the bottom face B. The top face of the flange is located within the duct of the funnel and the bottom face of the flange faces the housing of the female component. The bores through the flange are positioned between the cylinders mounted externally on the housing.

A plurality of control couplers 16 are mounted in cylinders 17 below the flange, each cylinder contains a coupler which may be extended through a bore in the flange to extend from the front face of the flange.

A substantially annular metal abutment surface 18 is mounted within the duct of the funnel behind the annular flange. The abutment surface is tapered from the wall of the housing towards the inner edge of the surface and terminates in a depending rim 19 within the female component.

One or more apertures (not shown) may be provided in the abutment surface to receive a locating key of a male component to assist in axial alignment of the components. In one embodiment, the aperture(s) may be extended into the abutment surface and may have a helical or sloping form to assist in rotating a male component into the required orientation on insertion.

In an alternative arrangement, the apertures may be provided in the male component and the locating keys provided on the abutment surface of the female component.

One or more actuation means 20 such as hydraulic cylinders 21 are provided radially within the abutment surface, said cylinders being extendible to apply a force radially via the extending rim of the abutment surface on a male component inserted into the female component.

Alternatively, the actuation means may be a piston, mechanical finger or lever arm.

Furthermore one or more hydraulic cylinders are mounted below the abutment surface and are connected thereto to raise and lower the abutment surface within the female component as will be further described below.

Latching means 22 are provided within the female component for mechanically retaining a male component of the connector in position within the female component. In this embodiment, the latching means is actuated by the hydraulic cylinders 23 provided in the mounting means secured to the outer surface of the housing of the female component.

A cam 24 is mounted on the piston carried within the cylinder, one of which is shown in FIG. 3. In an alternative arrangement (not shown) the cam may be integral with the piston. The cam extends into the housing of the female component underneath the hydraulic cylinder. The surface 25 of the cam remote from the cylinder may be tapered as shown in FIG. 3. The cam may have a reverse angle as will be described further below.

A cam follower 26 is mounted adjacent the tapered surface of the cam, the follower having a tapered surface 27 facing the cam and a profiled surface 28 at the other side thereof. The profiled surface in this embodiment is shown as one or more castilations. A slot may be provided in the cam follower for engagement with the reverse angle of the cam as described further below.

Vertical movement of the piston within the cylinder moves the cam vertically within the housing of the female component. As the tapered surface of the cam is raised and lowered, the cam follower is moved radially inwardly or outwardly against the cam.

A frame 29 is provided around the housing, the frame extending from the upper edge of the cone of the funnel to a ring 30 mounted at a point on the lower end of the female component or on the lubricator section below the female component. The frame comprises an open web of spars 31 which may have a metal grating between the spars. The spars and the grating if used provide protection to the component whilst allowing access for ROV or visual checks.

The male component of the connector is shown in FIG. 3 mounted on the end of a lubricator extension, however this could similarly be mounted on a riser extending to the surface or some other piece of equipment.

The male component comprises a hollow tubular mandrel 32 through which fluids can pass from the lower section of equipment through the connector and into the upper piece of equipment. The free end 33 of the mandrel is chamfered to aid insertion of the free end into the female component.

The outer circumference of the mandrel carries the main seal 34 to prevent fluids from breaching the connector. The main seal of the connector may be elastomeric or may be a metal to metal seal. In the embodiment shown the seal is provided by one or more resilient rings which are tightly secured around the mandrel.

The diameter of the mandrel above the main seal is enlarged through a flared skirt 35. Detents 36 are provided on the mandrel for locking the male component within the female component. In the embodiment shown, the detents are provided on a reduced diameter waist 37 of the mandrel behind the flared skirt 38.

The waist of the mandrel ends at an annular flange which provides a shoulder 39 leading to an upper section of the mandrel which has a similar external diameter as the skirt. Apertures 40 are provided in the outer surface of the upper section of the mandrel through which keys may extend as described more fully below.

The distal end 41 of the upper section of the mandrel terminates in a flared skirt 42 which is connected to a further annular flange 43. The skirt may be integrally formed with the flange. The external diameter of the annular flange matches that of the annular flange of the female component. Bores 44 are provided through the annular flange, said bores being alignable with the bores in the annular flange of the female component. Fewer bores may be provided in one or other of the annular flanges or the same number of bores may be provided in each.

The upper surface of the annular flange of the male component is provided with a hollow tubular nozzle 45 which in the embodiment shown is gently tapered from the flange to the free end of the nozzle. The tubular nozzle is coaxial with the hollow mandrel to provide a flow path through the male component. The free end 46 of the nozzle is chambered to receive the free end of a lubricator extension or riser or other piece of equipment for which connection is required.

The operation of the connector will now be described. The female component 2 of the connector is mounted on the free end of a lubricator section or the like by push fit connection, threaded connection or any other suitable connecting means. The male component 3 of the connector is mounted on the end of a further lubricator section or riser. There may be a push fit connection between the free end of the nozzle of the male component or a screw thread mounting or other suitable fixing may be provided.

The keys on the mandrel of the male component are extended from the apertures to assist in rotational alignment of the male component within the female component.

In a sub sea connection, it is likely that the male component will be lowered towards the female component although other configurations are also considered suitable.

As the male component nears the female component, the free end 33 of the hollow mandrel 32 of the male component is guided by the guide cone 11 of the female component. The hydraulic control couplers 16 of the female component are withdrawn below the surface of the annular flange 14 of the female component such that they do not impede the insertion of the male component 3 into the female component 2 and to prevent damage to the connectors during insertion.

A further advantage of the hydraulic control couplers 16 being withdrawn below the surface of the annular flange 14 is that they effectively block the bores 15 through the annular flange, thereby preventing debris from clogging the bores during the insertion process and, being pressure balanced, simultaneously allow the hydraulic supply lines to be pressure tested against the hydraulic couplers without the male component being inserted into the female component.

Furthermore, the inner surface 13 of the guide cone has a smooth profile to ensure that there is no snagging of the mandrel 32 upon the cone which provides additional protection to the components of the connector.

As the hollow mandrel 32 of the male component passes the guide cone 11, the keys 36 of the male component are received within the guide apertures of the female component which draws the male component into rotational alignment with the female component.

The flared skirt 35 of the male component engages with the annular abutment surface 18 of the female component which is in its raised position awaiting land out of the male component. This also holds the main seal 34 of the tubular mandrel out of engagement with the female component so ensuring that this is not damaged during the initial engagement of the components of the connector.

Once the mandrel of the male component is engaged in the annular abutment surface 18 of the female component, the radial hydraulic cylinder(s) 21 are actuated to apply a radial force on the extending rim 19 of the abutment surface which in turn causes the abutment surface to forcibly grip the mandrel of the male component.

The hydraulic cylinders 21 mounted below the abutment surface are then actuated to withdraw the abutment surface 18 into the female component thereby securely drawing the mandrel of the male component into the female component where the main seal of the connector is established between the male and female components.

The external pistons 23 on the housing 4 of the female component are then actuated such that the cams 24 are lowered with the pistons. As the cams descend within the female component, the tapered outer surface 25 of the cam(s) engage with the tapered inner surface 27 of the follower(s) 26 and the follower(s) are caused to move radially inwardly within the female component. The tapered surface generates a pre-load in the male component to increase the connector bending capacity. The castelations 28 of the follower are locked into position within the detents 36 of the mandrel of the male component.

This positive pull down of the male component into the female component ensures that the inherent resistance in engaging elastomeric seals cannot prevent the connector main seals 34 from engaging where connector weight alone is not sufficient but also facilitates the engagement of seals such as metal to metal seals that may require additional force to engage and/or preload.

As the mandrel component is drawn down into the female component, the annular flanges 14, 43 of the two components are drawn together. The hydraulic control line couplers 16 are extended by means of the application of hydraulic pressure through the bores 15 in the annular flange of the female component and into the bores of the annular flange of the male component. As the hydraulic couplers do not engage until after the male component has been fully drawn into the female component and locked in place, this ensures that the alignment, locking and hydraulic coupling are three fully independent operations rather than happening simultaneously as they do on existing connectors.

As the outer housing of the hydraulic connections remains stationary and all movement is contained internally, there is no need for a hydraulic hose to bridge the connection between the female connector and the hydraulic connections thereby avoiding the risk of damage to the hydraulic connections through continued flexing of such a hose. This also facilitates the use of hard piping to the couplers below the annular flange of the female component while avoiding the need to build in flexibility to allow for movement.

In the event of loss of hydraulic pressure maintaining the abutment surface of the female component in the lowered position, the mechanical latch between the male and female components is maintained thereby avoiding failure of the connector. This is enhanced by the fact that the locking pistons operate in a downward direction away from the surface thereby preventing movement from the locked position under the action of gravity.

In the event of loss of hydraulic pressure maintaining the hydraulic control line couplers in the extended position, the couplers are fully pressure balanced, generating no separation force and therefore ensuring that they will not separate under internal control line pressure. Hydraulic pressure on the 'retract' function is required to separate the hydraulic couplers. In addition the configuration of the hydraulic couplers is such that any internal pressure in the control line itself will act to maintain the coupler in the extended position.

When it is required to disconnect the two lubricator sections from one another the operation for connecting the two components of the connector are reversed. Once the fluid pressure below the connector is vented, for example by closing a valve below the connector, the couplers 16 between the annular flanges of the male and female components are lowered to their retracted position beneath the surface of the annular flange of the female component.

The external pistons are actuated to raise the cam(s) within the female component, thereby allowing the follower(s) to return to their radially outward position such that the mechanical latch between the male and female components is removed. The abutment surface 18 is then raised within the female component to raise the mandrel 32 of the male component within the female component thereby disengaging the main seal of the connector.

As the external pistons are raised to raise the abutment surface, the reverse angles on the cams 24 allow them to engage in slots on the followers 26 and actively withdraw the followers from the male component. The radial hydraulic actuator of the abutment surface is deactivated to release the radial grip on the mandrel of the male component and the male component is lifted out of the cone of the female component.

It will be appreciated that the connector of the present invention provides for a multi stage connection process in which the male component of the connector is protected during the initial alignment operation to prevent damage to the sealing components of the male connector.

The entire operation can be carried out remotely without the need for divers on hand to oversee the connection. An ROV can be deployed to the site to monitor the connection and the frame provided around the female component facilitates the visual checks which can assist in the connection operation.

It is anticipated that the use of a connector as described will reduce instances of damage occurring to the connector during installation and thereby reduce the downtime and man power required in order to remove, replace and repair such connectors in an off-shore environment.

As one of the primary operational functions of the connector is to transport heavy equipment subsea. It is essential that the load on the connector is secure at all times. This is important not only from the perspective of the onboard hazards resulting from a dropped object but also from the subsequent hazards resulting from an object falling onto the well control equipment below. The connector as described functions in the downward direction which ensures that in the case of all hydraulic control pressure being lost, then the activation piston cannot have a tendency to move to an unsafe position under the action of gravity. This provides a true failsafe operation.

Additionally, the connector serves the function of providing a primary barrier to well fluids while withstanding internal pressure forces and all externally applied forces. The connector of the present invention combines this basic function with the added function required for subsea use while keeping all the hydraulic control lines and functioning mechanisms outside of the primary well bore seal. Therefore any leakage or failure of hydraulic seals cannot create communication between the well bore and the control hydraulics.

The latching mechanism of the present invention is not exposed to fluid in the well bore, debris or added stimulation fluids. This aids in keeping the materials concerned free from corrosion and also prevents the possibility of seizure of a mechanism by means of accumulated debris.

In an alternative embodiment of the present invention, where no pre-load is required on the male component of the connector, the tapered surface of the cam follower 27 of the female component may be replaced with a flat surface. In this embodiment the cam slides behind the cam follower to provide a mechanical lock without any pre-load being placed on the male component of the connector The connector 1 as described is fully stackable due to the hollow nature of the male and female components and the lack of any obstructions internally to the fluid passage. This creates the ability to extend well intervention risers to allow for tool recovery without the need for a rig, deployment of longer tool strings or connection of a riser to surface without the need to recover the previously installed free-standing riser, which are all significant advantages in subsea well intervention.

Also, the connector has been designed to ensure that when stacked, control (whether electrical, electronic or hydraulic) is automatically passed from the lower connector to the higher connector to prevent the risk of accidental disconnection of the lower connector Furthermore, the connector has been designed specifically to allow a pressure control head variant such as for example a slickline or E-line to be interchanged with a full 7⅜" through bore male component, as described. Examples are shown in FIG. 6

Whilst the foregoing description has been drawn to a connector having hollow male and female components to enable the connector to allow for passage of well fluids therethrough, it is to be appreciated that the male component could be a solid body such as a test or lift mandrel used to seal the top of a riser to which a female component is mounted or to provide a platform for wirelining or tool recovery operations.

In another embodiment, it is envisaged that the external features of the male component may be as described above but the interior of the male component may be provided as one or more cartridges which can be interchanged depending upon the operation to be carried out. Therefore, in the event that a stacking connector is required, a cartridge is inserted into the male component to provide for such a through bore as described in the embodiment above. Where a test or lift mandrel is required, a blank cartridge may be provided which blocks off the hollow male component to allow for pressure testing of the riser below the female component. The same cartridge design can also be used for slickline and E-Line mandrels.

In a further embodiment of the present invention, where a test or lift mandrel which blocks off the passageway for well fluids through the female component is inserted in the female component for example for pressure testing, said test or lift mandrel is provided with a connection means to enable a line to be provided between the mandrel and a surface facility such as a floating platform or a vessel for the purpose of deploying the intervention system from the platform or vessel to the subsea wellhead. The connection means may be a ring provided on the top of the test mandrel. Means may be provided to enable remote release of the line from the ring such as in the event of loss of power to the vessel which otherwise would result in the floating platform or vessel being mechanically connected to the test mandrel but at the mercy of environmental conditions.

In this case, the connection means is automatically released to sever the physical connection between the test mandrel and the platform or vessel and to prevent any damage to the test mandrel, intervention system, subsea structure or the floating platform or vessel.

The means for enabling remote release may be either through the application of a hydraulic, electric or electronic signal (or a combination of the aforementioned) or through the loss of any or a combination of the above.

An interlock mechanism is included to ensure that the connection to the test or lift mandrel cannot be released until the intervention system has been securely locked onto the subsea wellhead to prevent accidental release of the intervention system during deployment.

Prior to unlocking the connector, the contents of the riser below the connector must be flushed out to prevent loss of hydrocarbons to the environment. The flushing outlet must be positioned as close as possible to the main well bore seal on the male part of the connector in order to ensure complete removal of contaminants. For this purpose a flushing port has been included in the 'nose' of the e-line, slickline and test and lift mandrel variants of the male half which routes the flushing process through the mandrel and immediately under the main well bore seal, ensuring a complete removal of contaminants The connector described above also has further application in respect to lubricator assemblies. The upper valve on a lubricator assembly has traditionally been configured in different ways on different systems. The valve is required to provide full bore access to allow the passage of the tool strings into the well. It also has to have the requirement to cut wireline. This arises from the scenario where the toolstring becomes stuck while it is straddling the main blow out pressure valves in the lower assembly and there is a section of the toolstring that cannot be cut by the shearing rams.

In this event the upper valve can cut the wire and close to isolate the well and allow further remedial action to be taken. Traditionally blow out pressure style rams have been used for this purpose in the past. One drawback is the fact that they extend outwards some distance and therefore make the upper assembly large and more susceptible to snagging by the guidelines.

The ball valve used for this purpose is slimmer and will provide a metal to metal seal on closure, however it is expensive and it relies on the sealing surface of the ball not being damaged while cutting to affect a seal.

One option to address this is to separate the cutting and sealing operations by conducting the cutting operation within the mandrel of the male component of the connector described above and retaining the sealing operation below the connector. This option has a number of advantages.

The cutting mechanism may be provided within the mandrel above the annular flange of the male component. The cutting mechanism is only required to cut wire, so may only require a bore of 1.00". This will drastically reduce the size of the cutting mechanism.

The cutting mechanism transfers within the male component of the connector when this is inserted into a different female component and therefore the cutting operation is transferable between connectors.

With the cutting mechanism transferred into the male component of the connector, the valve sealing mechanism can be of any type and a flapper type could now be used. The advantage of this is that the flapper valves are well established as sealing devices and when open a sleeve extends to cover all the seal surfaces and mechanism so preventing them from damage and debris ingress and provides a low cost and longer lasting solution.

Whilst the connector has been described as being most suitable for use in an off-shore environment, it is to be appreciated that the connector could of course be used in other applications where a connection is required to be established between two adjacent pieces of equipment.

What is claimed is:

1. A connector for connecting components of a subsea system, the connector comprising male and female components, a guide member provided on the female component for assisting preliminary orientation of the male component within the female component and an abutment surface on the female component which is selectively vertically moveable within the female component for drawing the male component into the female component and a latch member for securing the male component within the female component.

2. A connector according to claim 1, wherein the guide member comprises a tapered surface provided on the female component.

3. A connector according to claim 2, wherein the tapered surface is a cone provided on one end of the female component.

4. A connector according to claim 3, wherein the surface of the cone is smooth to prevent any damage to the male component during initial contact with the surface.

5. A connector according to claim 1, wherein the guide member comprises a cone on the male component to assist in the initial guidance of the male component into the female component.

6. A connector according to claim 1, wherein the male component comprises an abutment surface which co-operates with the abutment surface of the female component when the male component is inserted into the female component.

7. A connector according to claim 6, wherein the abutment surfaces are annular.

8. A connector according to claim 1, wherein a hydraulic member is provided for raising and lowering the female abutment surface.

9. A connector according to claim 6, wherein a radial force applicator is provided to mechanically grip the male component within the female component before drawing the male component into the female component.

10. A connector according to claim 9, wherein the radial force applicator is a hydraulic piston.

11. A connector according to claim 1, wherein the male and female components are provided with cooperating surfaces for establishing connection of hydraulic, electric or optical devices across the connector.

12. A connector according to claim 11, wherein the cooperating surfaces are annular.

13. A connector according to claim 11, wherein hydraulic, electric or optical coupling devices are provided on the female component, said devices being actuable to extend through the cooperating surface of the female component into the cooperating surface of the male component to establish a connection across the connector.

14. A connector according to claim 11, wherein hydraulic, electric or optical coupling devices are provided on the male component, said devices being actuable to extend through the cooperating surface of the male component into the cooperating surface of the female component to establish a connection across the connector.

15. A connector according to claim 1, wherein a frame is provided around the female component to allow for visual inspection of the component and ROV manipulation of the component.

16. A connector according to claim 1, wherein the latch member comprises one or more locking members on the female component which are extendable into one or more detents in the male component.

17. A subsea system incorporating a connector according to claim 1.

18. A method of connecting components of a subsea system together comprising the steps of guiding a male component of the connector into a female component of the connector by bringing the male component into contact with a guide member provided on the female component in a preliminary orientation and subsequently operating a selectively vertically moveable abutment surface within the female component to draw the male component into the female component before locking the male component into position within the female component thereby creating full bore access axially through the connector.

19. A method according to claim 18, wherein an abutment surface of the male connector is brought into contact with the abutment surface of the female connector and the male component is coupled to the female component.

20. A method according to claim 19, wherein the abutment surface of the female component is lowered within the female component to draw the male component coupled thereto into a locking position.

* * * * *